US009690233B2

(12) United States Patent
Hamada et al.

(10) Patent No.: US 9,690,233 B2
(45) Date of Patent: Jun. 27, 2017

(54) DEVELOPING DEVICE, PROCESS CARTRIDGE, AND IMAGE FORMING APPARATUS INCORPORATING SAME

(71) Applicants: Daisuke Hamada, Kanagawa (JP); Jun Shiori, Kanagawa (JP); Hideo Yoshizawa, Kanagawa (JP); Shingo Kuboki, Kanagawa (JP); Takahiro Adachi, Kanagawa (JP)

(72) Inventors: Daisuke Hamada, Kanagawa (JP); Jun Shiori, Kanagawa (JP); Hideo Yoshizawa, Kanagawa (JP); Shingo Kuboki, Kanagawa (JP); Takahiro Adachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/092,144

(22) Filed: Apr. 6, 2016

(65) Prior Publication Data

US 2016/0306300 A1 Oct. 20, 2016

(30) Foreign Application Priority Data

Apr. 20, 2015 (JP) ..... 2015-086306
Jan. 29, 2016 (JP) ..... 2016-016344

(51) Int. Cl.
*G03G 15/09* (2006.01)

(52) U.S. Cl.
CPC ..... *G03G 15/0942* (2013.01)

(58) Field of Classification Search
CPC ..... G03G 15/09; G03G 15/0942
USPC ..... 399/267, 103
See application file for complete search history.

(56) References Cited

U.S. PATENT DOCUMENTS

| | | | | |
|---|---|---|---|---|
| 5,887,224 | A | 3/1999 | Mizuishi et al. | |
| 2004/0223779 | A1 | 11/2004 | Satoh | |
| 2006/0083541 | A1* | 4/2006 | Nagata | G03G 15/0942 399/103 |
| 2011/0211854 | A1 | 9/2011 | Shiori et al. | |
| 2011/0229193 | A1* | 9/2011 | Okabe | G03G 21/181 399/110 |
| 2012/0093528 | A1 | 4/2012 | Shiori et al. | |
| 2012/0230711 | A1 | 9/2012 | Shiori et al. | |
| 2014/0064756 | A1 | 3/2014 | Sugiyama et al. | |

(Continued)

FOREIGN PATENT DOCUMENTS

| | | |
|---|---|---|
| JP | 10-069155 | 3/1998 |
| JP | 2004-252193 | 9/2004 |

(Continued)

*Primary Examiner* — Sophia S Chen
(74) *Attorney, Agent, or Firm* — Duft Bornsen & Fettig, LLP

(57) ABSTRACT

A developing device includes a casing having an opening, the casing to contain developer, and a developer bearer including a magnetized range to cause developer to stand on end on a surface of the developer bearer and an end range outside the magnetized range in a longitudinal direction of the developer bearer. The developer bearer is disposed in the casing and partly exposed from the opening with a casing gap secured between the surface of the developer bearer and an inner face of the casing. The developer bearer generates, by rotation, sucked-in airflow to collect a floating toner from the opening into the casing, and the casing gap is smaller in the end range than the magnetized range.

11 Claims, 8 Drawing Sheets

(56) References Cited

U.S. PATENT DOCUMENTS

| | | | | |
|---|---|---|---|---|
| 2014/0334851 | A1* | 11/2014 | Izumi | G03G 15/0942 399/267 |
| 2014/0356030 | A1* | 12/2014 | Fukuda | G03G 15/09 399/267 |
| 2016/0004184 | A1 | 1/2016 | Kikuchi et al. | |

FOREIGN PATENT DOCUMENTS

| | | |
|---|---|---|
| JP | 2006-113408 | 4/2006 |
| JP | 2008-134404 | 6/2008 |
| JP | 2014-219502 | 11/2014 |

* cited by examiner

DEVELOPING DEVICE, PROCESS CARTRIDGE, AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2015-086306 filed on Apr. 20, 2015 and 2016-016344 filed on Jan. 29, 2016 in the Japan Patent Office, the entire disclosure of each of which is hereby incorporated by reference herein.

BACKGROUND

Technical Field

Embodiments of the present invention generally relate to a developing device, a process cartridge, and an image forming apparatus, such as a copier, a printer, a facsimile machine, or a multifunction peripheral (MFP or multifunction machine) having at least two of copying, printing, facsimile transmission, plotting, and scanning capabilities.

Description of the Related Art

Electrophotographic image forming apparatuses include a developing device employing either one-component developer (i.e., toner) or two-component developer including toner and carrier.

Developing devices include, for example, a developer bearer having multiple magnetic poles to cause the developer to stand on end (in the form of magnetic brush) on a surface of the developer bearer. Then, the toner in the magnetic brush is transferred to an electrostatic latent image on a latent image bearer, thereby visualizing the latent image.

It is possible that the magnetic brush on the surface of the developer bearer contains insufficiently charged toner, the charge amount of which is insufficient for the toner to electrostatically adhere to the carrier. The insufficiently charged toner can float around the developing device and soil peripheral equipment or recording media.

SUMMARY

An embodiment of the present invention provides a developing device that includes a casing having an opening and a developer bearer disposed in the casing to be partly exposed from the opening, with a casing gap secured between a surface of the developer bearer and an inner face of the casing. The casing contains developer, and the developer bearer includes a magnetized range to cause developer to stand on end on the surface of the developer bearer and an end range outside the magnetized range in a longitudinal direction of the developer bearer. The developer bearer generates, by rotation, sucked-in airflow to collect a floating toner from the opening into the casing, and the casing gap is smaller in the end range than the magnetized range.

In another embodiment, a process cartridge includes a latent image bearer to bear a latent image and the above-described developing device to develop the latent image on the latent image bearer.

In yet another embodiment, an image forming apparatus includes a plurality of process cartridges corresponding to the number of image formation colors. Each of the plurality of process cartridges includes a latent image bearer to bear a latent image and the above-described developing device to develop the latent image on the latent image bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
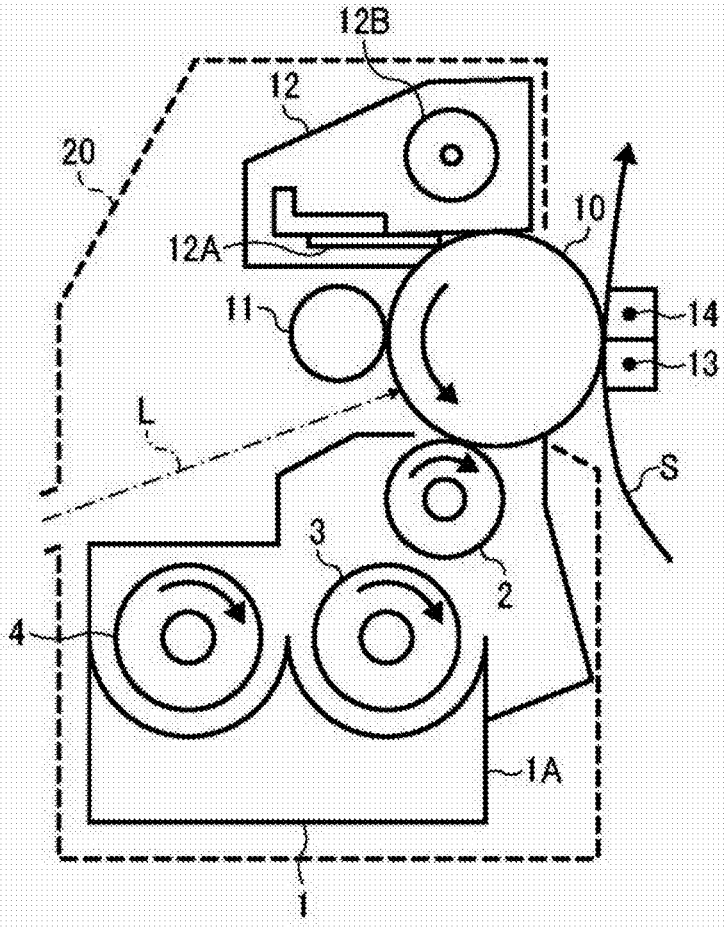
FIG. 1 is a schematic view of a developing device according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

Figure 2:
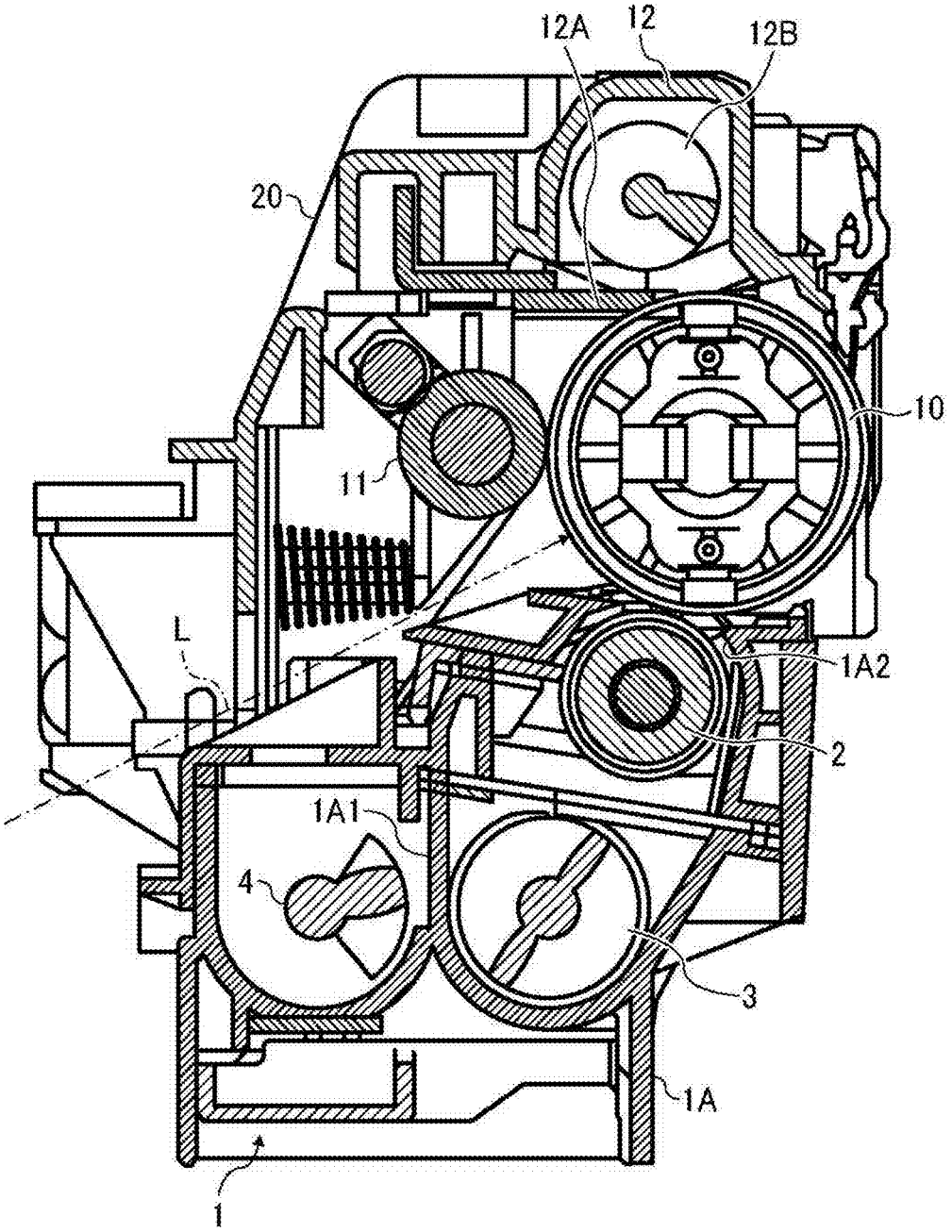
FIG. 2 is a cross-sectional view of the developing device illustrated in FIG. 1.

FIGS. 1 and 2 illustrate a process cartridge 20, in which a photoconductor drum 10, serving as a latent image bearer, and a developing device 1 are housed in a common housing of the process cartridge 20. The process cartridge 20 includes the developing device 1, the photoconductor drum 10, a charging device 11, and a cleaning device 12 disposed around the photoconductor drum 10 and used in image formation.

Figure 9:
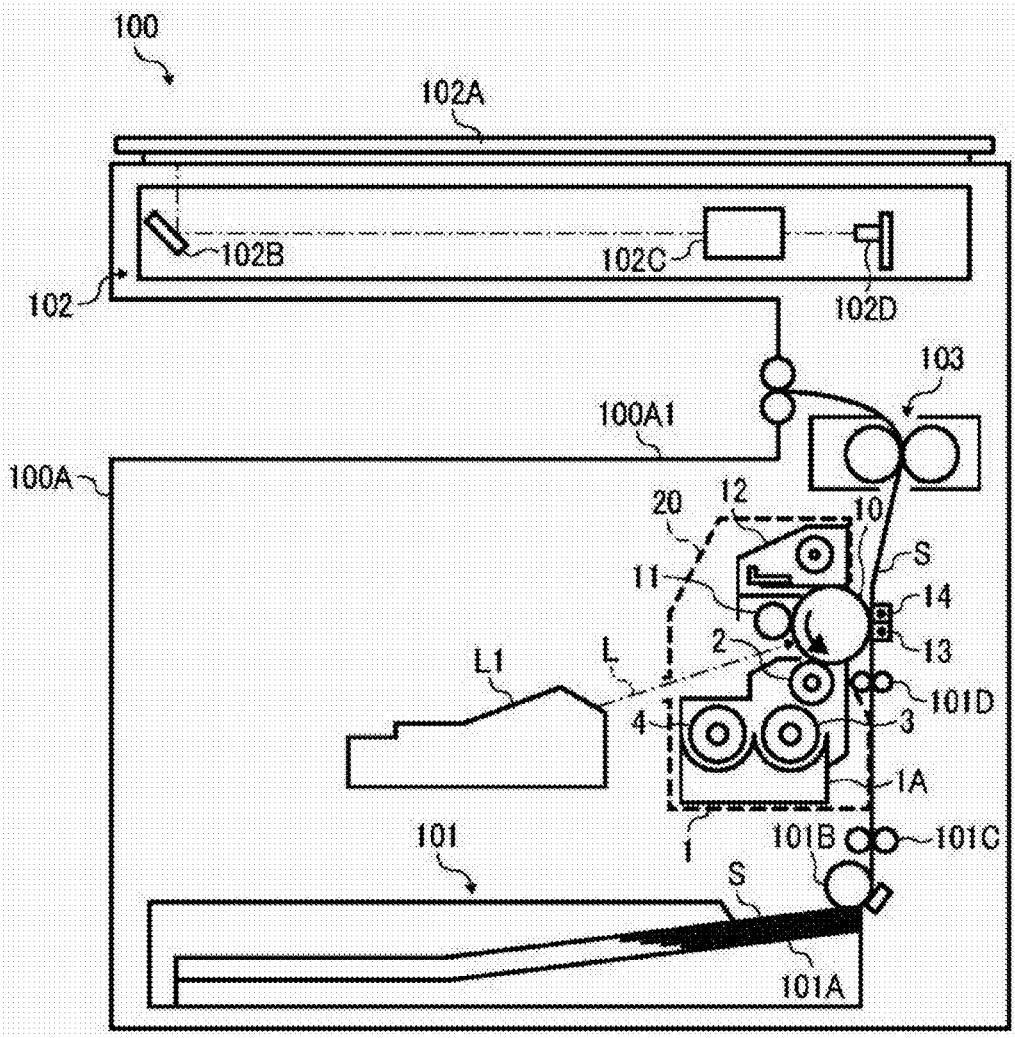
FIG. 9 is schematic a cross-sectional view of an image forming apparatus including the developing device illustrated in FIG. 1.

FIG. 9 illustrates an image forming apparatus 100 according to the present embodiment. The process cartridge 20 is removably insertable into an apparatus body of the image forming apparatus 100. When the operational life of a component of the process cartridge 20 expires, the process cartridge 20 is removed from the apparatus body, and the component is replaced. Thus, replacement is facilitated.

Referring to FIGS. 1 and 9, while the photoconductor drum 10 rotates in the direction indicated by an arrow illustrated in FIG. 1, the charging device 11 uniformly charges the surface of the photoconductor drum 10, a writing device L1 (in FIG. 9) forms a latent image on the surface of the photoconductor drum 10 with a writing beam L, and the developing device 1 visualizes (i.e., develops) the latent image.

A transfer device 13 illustrated in FIGS. 1 and 9 transfers the visible image, that is, a toner image, from the photoconductor drum 10 onto a sheet S of recording media (e.g., paper). In both drawings, reference numeral 14 represents a charger disposed adjacent to the transfer device 13. The charger 14 electrostatically separates the sheet P from the photoconductor drum 10.

It is to be noted that although the image forming apparatus 100 employs direct transferring in which a toner image on the photoconductor drum 10 is directly transferred onto the sheet S, an image forming apparatus according to another embodiment employs intermediate transferring in which a toner image is primarily transferred from the latent image bearer onto an intermediate transfer member (e.g., an intermediate transfer belt or an intermediate transfer drum) and secondarily transferred therefrom onto the sheet. The intermediate transfer member is used in image forming apparatuses employing intermediate transferring, such as, multicolor image forming apparatuses to superimpose multiple different-color toner images one on another. The superimposed toner images are transferred onto the sheet at a time.

After the toner image is transferred from the photoconductor drum 10, the cleaning device 12 removes toner (i.e., untransferred toner) remaining thereon, and a discharger removes remaining electrical charges.

The cleaning device 12 includes a cleaning blade 12A to collect the untransferred toner from the photoconductor drum 10 and a collecting screw 12B disposed in a collecting passage through which the collected toner is transported to the developing device 1. Alternatively, when the collected toner contains insufficiently charged toner, which does not suit for image developing, and paper dust, the collected toner is transported to a waste toner tank.

The developing device 1 is disposed facing the photoconductor drum 10 and includes a casing 1A (i.e., a developer container or a developing chamber) and a rotatable developer bearer 2 disposed in the casing 1A. The developer bearer 2 causes toner to stand on end on the surface of the developer bearer 2 with a magnetic force and supply the toner to the photoconductor drum 10. The developer bearer 2 has an interior structure similar to an interior structure of a developing roller 81 illustrated in FIG. 5 of U.S. Pat. No. 7,103,298-B2, which is hereby incorporated by reference herein.

As illustrated in FIG. 2, the casing 1A includes a pair of compartments divided in a horizontal direction from each other by a partition 1A1. Of the pair of compartments horizontally adjacent to each other, a compartment disposed beneath the developer bearer 2 contains a developer supply screw 3 and the other compartment contains a developer collecting screw 4.

Thus, the developing device 1 includes the pair of compartments to contain two screws having different capabilities, respectively. However, the direction in which the compartments are divided is not necessarily horizontal but can be vertical or oblique depending on the developer chamber type.

Of the developer supply screw 3 and the developer collecting screw 4, the developer supply screw 3 has a capability to supply the developer to the developer bearer 2 while transporting the developer, and the developer collecting screw 4 has a capability to transport the developer.

The developer bearer 2, the developer supply screw 3, and the developer collecting screw 4 are disposed with axial directions thereof (i.e., longitudinal directions) perpendicular to the surface of the paper on which FIG. 2 is drawn.

The partition 1A1 includes notches as communication openings (through hole) at positions corresponding to the longitudinal ends of the developer supply screw 3 and the developer collecting screw 4. With the openings, the two compartments communicate with each other.

Each of the developer supply screw 3 and the developer collecting screw 4 has a shaft and a spiral blade winding around the outer circumference of the shaft. When the spiral blades of the developer supply screw 3 and the developer collecting screw 4 wind in an identical direction, the developer supply screw 3 and the developer collecting screw 4 are rotated in opposite directions. When the spiral blades thereof wind in opposite directions, the developer supply screw 3 and the developer collecting screw 4 are rotated in an identical direction. In the present embodiment, the rotation directions thereof are identical.

With this structure, inside the casing 1A, the developer is transported along the axial direction in the opposite directions in the two compartments partitioned from each other. The developer enters to the other compartment through the communication opening of the partition 1A1 to circulate inside the casing 1A.

In the developing device 1, while the developing device 1 operates, that is, the developer bearer 2 rotates in the direction indicated by arrow Y1 (in FIG. 3), the magnetic brush (formed by developer T standing on end, illustrated in FIG. 3) on the surface of the developer bearer 2 moves along an inner face (an inner wall 1A2 in FIG. 3) of the casing 1A after passing through the developing range, where the developer bearer 2 is exposed from an opening 1AC (in FIG. 3) of the casing 1A and faces the photoconductor drum 10. As the magnetic brush moves along the inner face of the casing 1A, ambient air is sucked in the casing 1A from the opening 1AC, and negative pressure is caused.

With airflow arising due to the negative pressure, toner floating between the developer bearer 2 and the photoconductor drum 10 is collected into the casing 1A. In particular, the airflow collects the insufficiently charged toner, which floats downstream from the developing range in the direction (Y1 in FIG. 3) of rotation of the developer bearer 2. In addition to the capability to collect the insufficiently charged toner from outside the developing device 1, the airflow has a capability to inhibit the toner in the developing device 1 from leaking outside the developing device 1.

Figure 3:
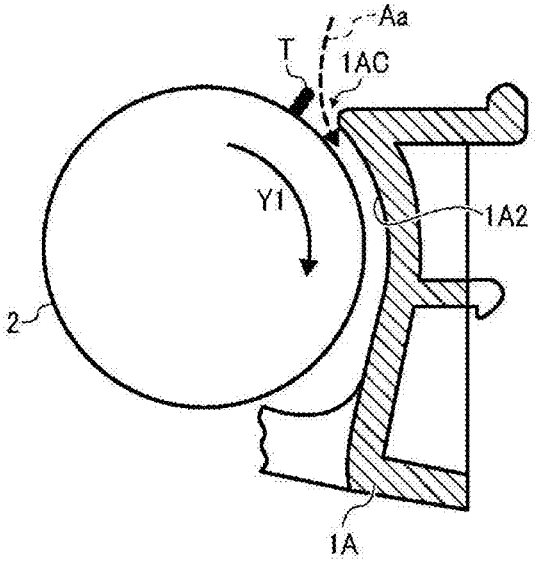
FIG. 3 is a schematic view that illustrates airflow generated in the developing device illustrated in FIG. 1.

The airflow to collect the insufficiently charged toner into the casing 1A arises as follows. As illustrated in FIG. 3, on the upstream side in the direction in which the magnetic brush of developer T standing on end on the developer bearer 2 moves along the inner wall 1A2 of the casing 1A, ambient air around the developer bearer 2 is sucked into the casing 1A. In FIG. 3, broken arrow Aa represents the flow of ambient air around the developer bearer 2 being sucked into the casing 1A (hereinafter "ambient airflow Aa").

The insufficiently charged toner rides on the ambient airflow Aa, which flows into the casing 1A and is sucked into the casing 1A. Accordingly, leak of developer outside the developing device 1 is inhibited, and contamination of peripheral devices and sheets caused by the leak of developer is inhibited.

Figure 4:
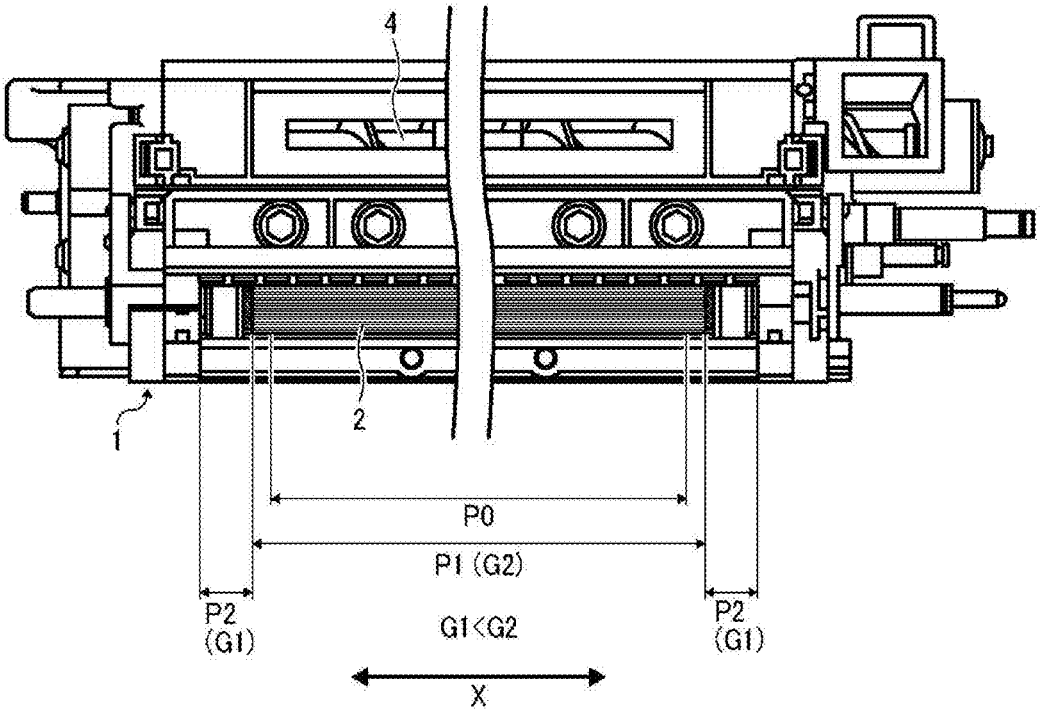
FIG. 4 illustrates ranges, in a longitudinal direction, of a developer bearer of the developing device illustrated in FIG. 1.
Figure 5:
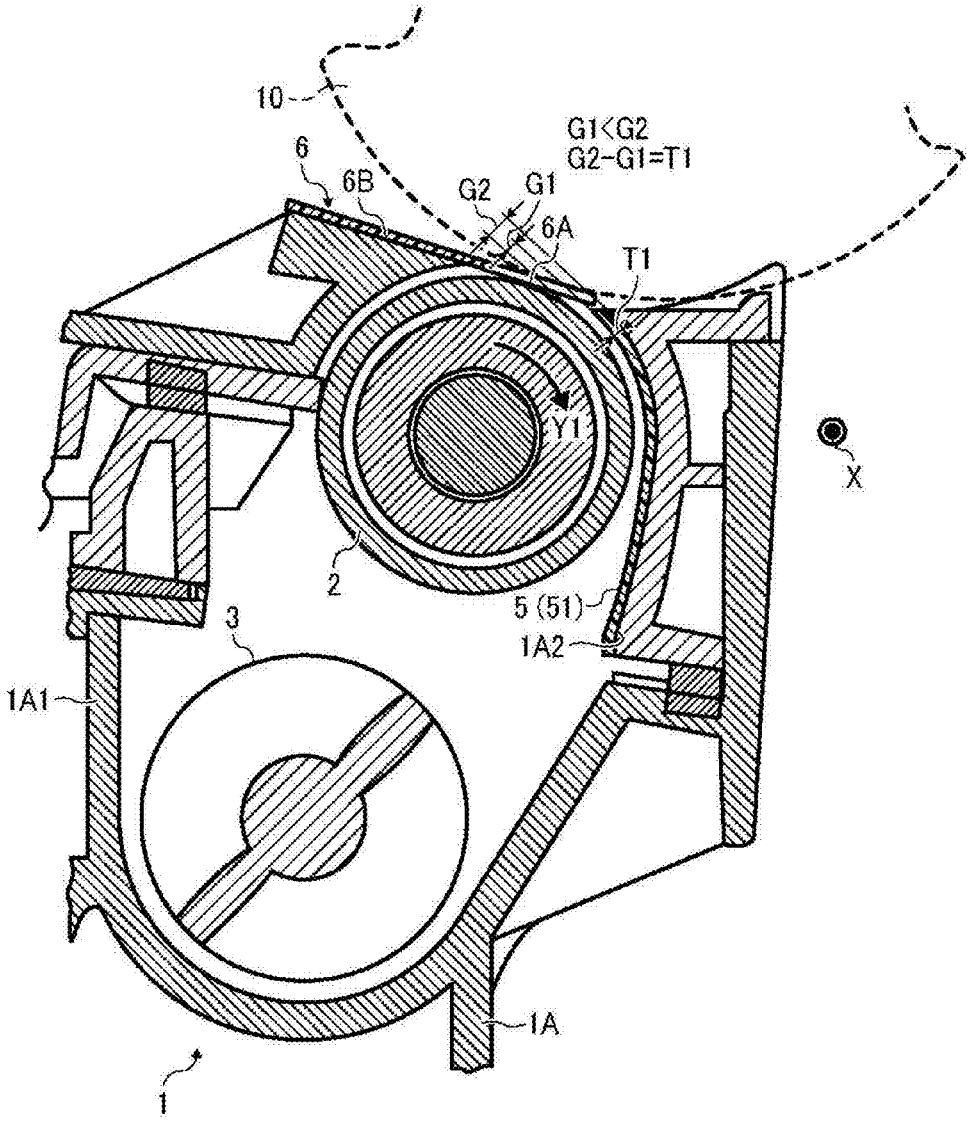
FIG. 5 is an enlarged view of a structure of the developing device illustrated in FIG. 2.

Referring to FIG. 4, in the longitudinal direction thereof, the developer bearer 2 has a magnetized range P1 and end ranges P2, outside the magnetized range P1. The end ranges P2 include shafts at both ends of the developer bearer 2. The strength of the ambient airflow Aa illustrated in FIG. 3 is different between the magnetized range P1 and the end ranges P2. In FIG. 4, reference character "X" represents the longitudinal direction of the developer bearer 2 (hereinafter "longitudinal direction X") identical to the axial direction thereof. The longitudinal direction X is parallel to the surface of the paper on which any of FIGS. 1 through 3, 5, and 9 is drawn and coincides with the longitudinal directions of the developer supply screw 3 and the developer collecting screw 4. In FIG. 5, the longitudinal direction X is represented by a double circle (with the inner circle solid filled).

In the longitudinal direction X, in the magnetized range P1 of the developer bearer 2, the ambient air Aa flowing into the casing 1A (sucked-in airflow Ab in FIG. 10) as the magnetic brush of developer T (in FIG. 3) moves is greater in quantity and strength (wind pressure) since the magnetic brush is generated in the magnetized range P1.

Figure 10:
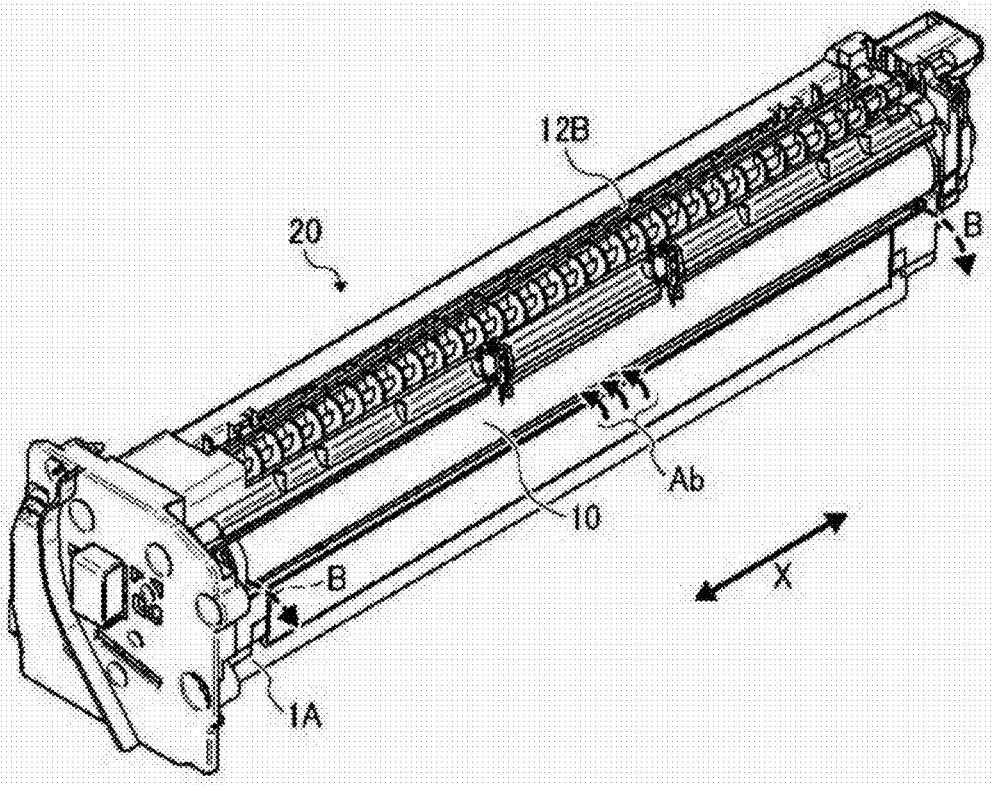
FIG. 10 is a perspective view illustrating possible locations of air blowing out a developing device.

By contrast, in the end ranges P2, outside air is less likely to be sucked in by the magnetic brush. As illustrated in FIG. 10, outside the magnetized range P1 in the longitudinal direction X, there are areas where air can blow out as indicated by arrow B in FIG. 10 from the casing 1A as the air accumulating on the side of the magnetized range P1 is pushed to the end ranges P2.

Pressure in the developing device 1 tends to be increased by the sucked-in air and rotation of the blade of the conveying screw disposed in the developing device 1. If air blows out the developing device 1 due to the increased internal pressure, not only the insufficiently charged toner, but also the toner retained in the developing device 1 can leak from the developing device 1, resulting in contamination of the peripheral devices and recording media.

To prevent the air from blowing out in the axial end areas of the developer bearer 2, in the developing device 1 according to the present embodiment, the casing 1A (see FIG. 4) includes an air vent through which the space at the end in the longitudinal direction X communicates with the outside. The air vent is disposed above the developer collecting screw 4. To prevent the insufficiently charged toner from leaking through the air vent, a filter is disposed in the air vent.

Generally, in a configuration including the filter, when the filter is clogged with toner or the like with elapse of time, the flow of air is hindered. Similar to the case illustrated in FIG. 10, in the developing device 1, in the end areas in the longitudinal direction X of the developer bearer 2, that is, the end ranges P2 outside the magnetized range P1, there can be force to cause air to blow out the developing device 1. If air blows out the developing device 1, the toner accumulating in the casing 1A blows out the developing device 1, and the toner floating outside the developing device 1 is not collected.

To inhibit the air from blowing out the developing device 1 from the end ranges P2 outside the magnetized range P1 in the longitudinal direction X, the developing device 1 illustrated in FIG. 4 includes a structure to prevent or alleviate degradation of the capability to suck in air in the end ranges P2.

Specifically, as illustrated in FIG. 5, gap adjusters 5 are disposed to face the developer bearer 2. The gap adjusters 5 are attached to the inner wall 1A2 on the downstream side of the opening 1AC or the developing range in the direction Y1 in which the developer bearer 2 rotates. The gap adjusters 5 are disposed to face the end ranges P2 in the longitudinal direction X of the developer bearer 2.

In the end ranges P2 in the longitudinal direction X, a face 51 of the gap adjuster 5 serves as the inner face facing the developer bearer 2 and defines a gap between the casing 1A and the developer bearer 2. In the magnetized range P1 (without the gap adjuster 5) in the longitudinal direction X, the inner wall 1A2 of the casing 1A serves as the inner face facing the developer bearer 2 and defines the gap between the casing 1A and the developer bearer 2.

In FIG. 5, a reduced casing gap G1 is secured between the surface of the developer bearer 2 and the face 51 of the gap adjuster 5, and a casing gap G2 is secured between the surface of the developer bearer 2 and the inner wall 1A2 in the range without the gap adjuster 5. The reduced casing gap G1 is reduced from the casing gap G2 by a thickness T1 of the gap adjuster 5. As illustrated in FIG. 5, relations G1<G2 and G2-G2=T1 are established. Thus, the end ranges P2 illustrated in FIG. 4 are also referred to as reduced-gap areas.

The casing gap G2 is sized to keep the strength of the sucked-in airflow to bare minimum to prevent or inhibit the toner in the casing 1A from leaking outside the developing device 1. The reduced casing gap G1 is sized to make the strength of the sucked-in airflow greater than the airflow strength attained by the casing gap G2 to prevent or inhibit the toner in the casing 1A from leaking outside the developing device 1.

Differently from the magnetized range P1, in the end ranges P2, the sucked-in air is less likely to occur as the magnetic brush of developer T (in FIG. 3) moves. However, with the relation G1<G2, the air pushed out from the magnetized range P1 in the casing 1A is inhibited from blowing from the end ranges P2 to the outside of the developing device 1.

Compared with the magnetized range P1, in the end ranges P2, the strength of air sucked in by the movement of the magnetic brush is weaker, and the insufficiently charged toner sucked in the casing 1A is likely to leak out. However, with the relation G1<G2 to enhance the strength (wind speed) of the sucked-in airflow caused by the rotation of the developer bearer 2 in the end ranges P2, the toner inside the casing 1A is inhibited from leaking out the developing device 1.

More specifically, since the reduced casing gap G1 is reduced from the casing gap G2 by the thickness T1 of the gap adjuster 5, the airflow speed (wind speed) is increased in the end ranges P2 (the reduced-gap areas) where the gap between the developer bearer 2 and the casing 1A is narrower in the longitudinal direction X. The increase in the airflow speed enhances, locally in the end ranges P2, the sucked-in airflow flowing from the outside into the casing 1A as the developer bearer 2 rotates. This structure inhibits the toner, which includes the insufficiently charged toner once sucked in the casing 1A, from leaking outside the casing 1A.

As illustrated in FIG. 4, in the longitudinal direction X, the magnetized range P1 includes a sheet feeding span P0 and extends outside the sheet feeding span P0. Accordingly, in the sheet feeding span P0, the magnetic brush reliably sucks air in, and the toner is reliably inhibited from blowing out the developing device 1. Therefore, the sheet P passing through the sheet feeding span P0 is protected from contamination with toner.

Differently from the end ranges P2, since the sucked-in airflow is reliably generated by the magnetic brush in the magnetized range P1, it is less necessary to narrow the casing gap G2 to enhance the airflow. Accordingly, the casing gap G2 is greater than the reduced casing gap G1 to such an extent that the insufficiently charged toner is sucked in and the toner is inhibited from blowing out the developing device 1 (G1<G2, refer to FIGS. 4 and 5). Therefore, the pressure of the sucked-in airflow is lower in the magnetized range P1 than the end ranges P2, and the pressure of air moving from the magnetized range P1 to the end ranges P2 in the casing 1A is lower. Additionally, the total amount of air sucked in the casing 1A per unit time is restricted throughout the magnetized range P1 and the end ranges P2. Accordingly, the pressure and the volume of the air sucked in the casing 1A are restricted in the entire length in the longitudinal direction X, and the filter is inhibited from being clogged.

As described above, the gap between the developer bearer 2 and the inner wall 1A2, is set to the casing gap G2 (in FIG. 5) in the magnetized range P1 (in FIG. 4) and to the reduced casing gap G1 (in FIG. 5) in the end ranges P2 (in FIG. 4).

As the thickness T1 of the gap adjuster 5 increases, the reduced casing gap G1 becomes narrower to increase the strength of the sucked-in airflow. However, a cross-sectional area for the sucked-in airflow to pass through decreases. If the cross-sectional area for the sucked-in airflow to pass through is small, it is possible that some of the insufficiently charged toner fails to enter the casing 1A depending on the amount of the insufficiently charged toner collected by the sucked-in airflow. The insufficiently charged toner failing to enter the casing 1A accumulates outside the developing device 1, around the gap adjuster 5, as if the toner overflows from the reduced casing gap G1 of the gap adjuster 5.

In view of the foregoing, the gap adjuster 5 is made of an elastic material that is elastically deformable, to the extent in which G1<G2 is satisfied, in accordance with the pushing force exerted by the insufficiently charged toner passing through the reduced casing gap G1. This elastic deformation of the gap adjuster 5 is greater than the elastic deformation of the casing 1A caused by the toner passing through the casing gap G2.

For example, the gap adjuster 5 is made of urethane foam and deformable, pushed by the insufficiently charged toner and the developer. When the insufficiently charged toner flows in the reduced casing gap G1, the gap adjuster 5 increases the reduced casing gap G1 in accordance with the toner particle diameter.

It is preferred that the elasticity and the hardness of the gap adjuster 5 be experimentally determined to have such a flexibility that the gap adjuster 5 deforms upon the force of collision exerted by a predetermined amount of toner conveyed by the sucked-in airflow at a predetermined speed, for example. The predetermined amount and the predetermined speed are obtained from the size of the reduced casing gap G1.

The elasticity and the hardness of the gap adjuster 5 are adjustable with the degree of foam of the urethane foam or the like.

When the gap adjuster 5 is made of an elastic material, the insufficiently charged toner can pass through the reduced casing gap G1 since the reduced casing gap G1 is widened by the pushing force of the insufficiently charged toner conveyed into the casing 1A by the sucked-in airflow. Consequently, combined with the local enhancement of the sucking-in airflow in the end ranges P2, blocking of the insufficiently charged toner is suppressed even when the relation G1<G2 is established.

It is possible that the insufficiently charged toner and the developer sucked in the casing 1A are inhibited from moving by the contact with the gap adjuster 5. Accordingly, the surface roughness of the face 51 of the gap adjuster 5 facing the developer bearer 2 is determined to alleviate inhibition of movement of the toner and the developer by the contact with the gap adjuster 5. That is, the face 51 of the gap adjuster 5 overlying the inner wall 1A2 has a surface roughness to secure a smoothness to allow the insufficiently charged toner and the developer to slide thereon. In other words, the face 51 of the gap adjuster 5 has a surface roughness that attains a smoothness higher than a smoothness of the inner wall 1A2 facing the casing gap G2 without the gap adjuster 5.

The surface roughness of the gap adjuster 5 is set to alleviate the inhibition of the movement of the insufficiently charged toner passing through the reduced casing gap G1. As the surface roughness decreases, the smoothness is enhanced, thus reducing the resistance in sliding between the insufficiently charged toner and the gap adjuster 5. It is to be noted that, the term "sliding" used above means moving slidingly and the term "resistance in sliding" means the resistance generated in rubbing in the state of sliding.

The surface roughness thus set can facilitate the sliding of the insufficiently charged toner and the developer in contact with the face 51 of the gap adjuster 5 overlying the inner wall 1A2. Accordingly, even when the area of contact between the gap adjuster 5 and the insufficiently charged toner increases due to the elastic deformation of the gap adjuster 5, the resistance against the insufficiently charged toner flowing into the casing 1A is alleviated. The setting of the surface roughness and the elastic deformation of the gap adjuster 5 improve collecting the insufficiently charged toner into the casing 1A. Additionally, since the resistance against the friction of the insufficiently charged toner is alleviated and sliding movement of the insufficiently charged toner is made smooth, degradation, such as wear, of the face 51 of the gap adjuster 5 overlying the inner wall 1A2 is suppressed.

It is to be noted that the surface roughness of the face 51 of the gap adjuster 5 can be decided considering, not limited to the sliding of the insufficiently charged toner, but also other factors such as fluid characteristic of flowing air that contacts the face 51 of the gap adjuster 5. Although the size of the reduced casing gap G1 can be set with the shape of the casing 1A itself, setting the reduced casing gap G1 with the gap adjuster 5, which is a separate component, is advantageous in easily designing the elasticity, the surface roughness, or both of the inner wall 1A2 defining the reduced casing gap G1 and easily designing the size of the reduced casing gap G1.

Figure 6:
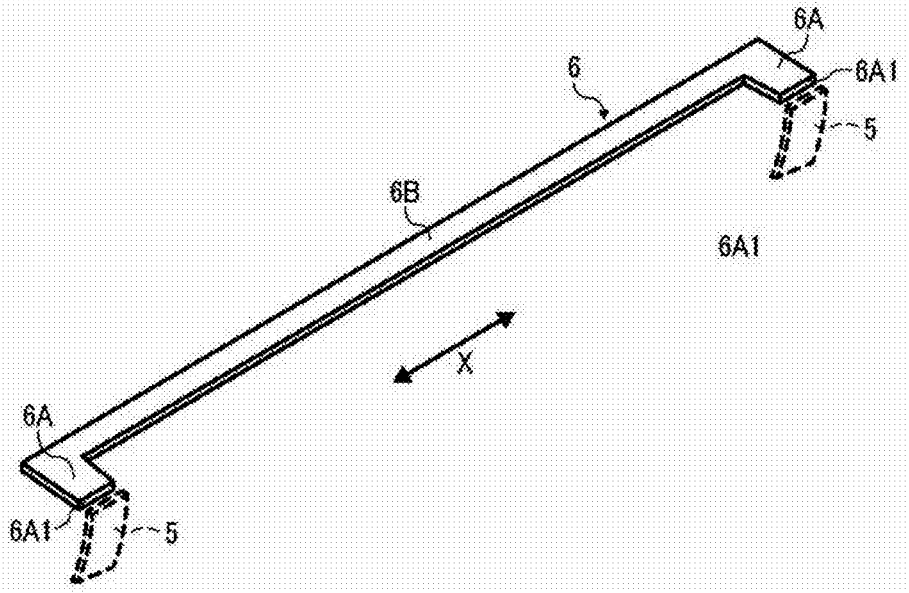
FIG. 6 is a schematic perspective view illustrating a position of a seal corresponding to gap adjusters according to an embodiment.
Figure 7:
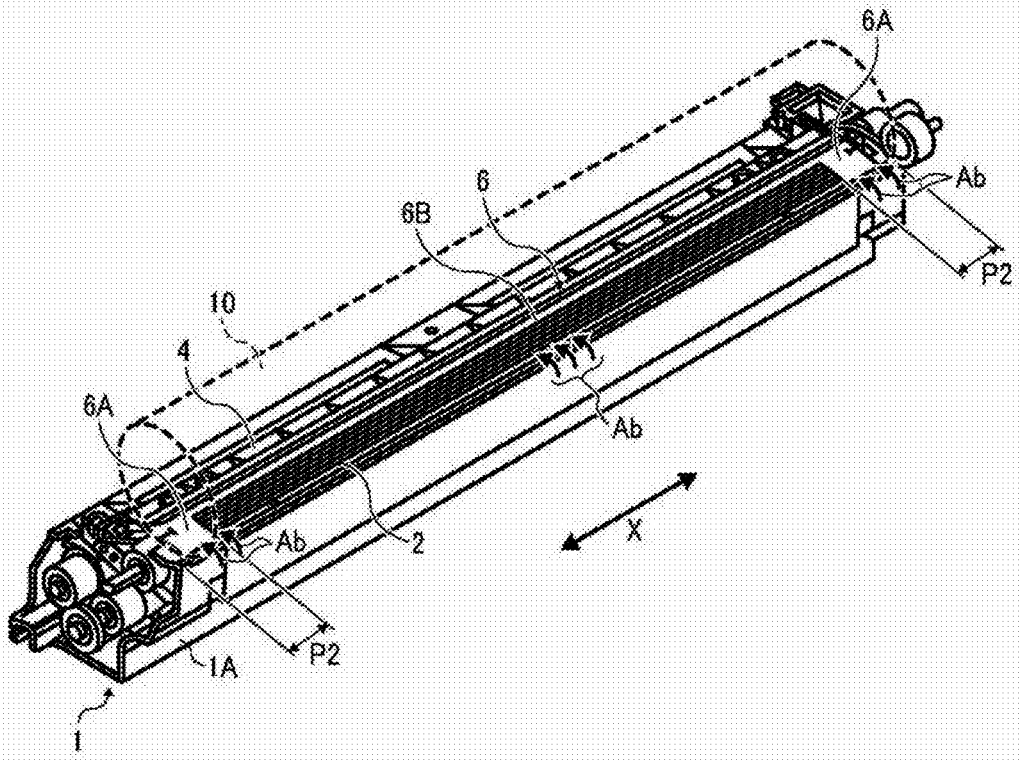
FIG. 7 is a perspective view illustrating the position of the gap adjusters and the seal illustrated in FIG. 6, in the developing device illustrated in FIG. 2.

As illustrated in FIGS. 5 through 7, the developing device 1 further includes a seal 6 to block the air that is about to blow out from the end ranges P2 to the outside of the casing 1A (the developer container). For example, the seal 6 is attached to an upstream rim (defining the opening 1AC in FIG. 3) of the casing 1A in the direction Y1 in which the developer bearer 2 rotates.

The seal 6 is made of a polyethylene terephthalate (PET) plate or a PET sheet in the present embodiment. As illustrated in FIG. 6, the seal 6 includes a pair of end seal portions 6A and a long seal portion 6B. The end seal portions 6A are disposed at both sides in the longitudinal direction X of the developer bearer 2, and the long seal portion 6B connects the end seal portions 6A.

Figure 8:
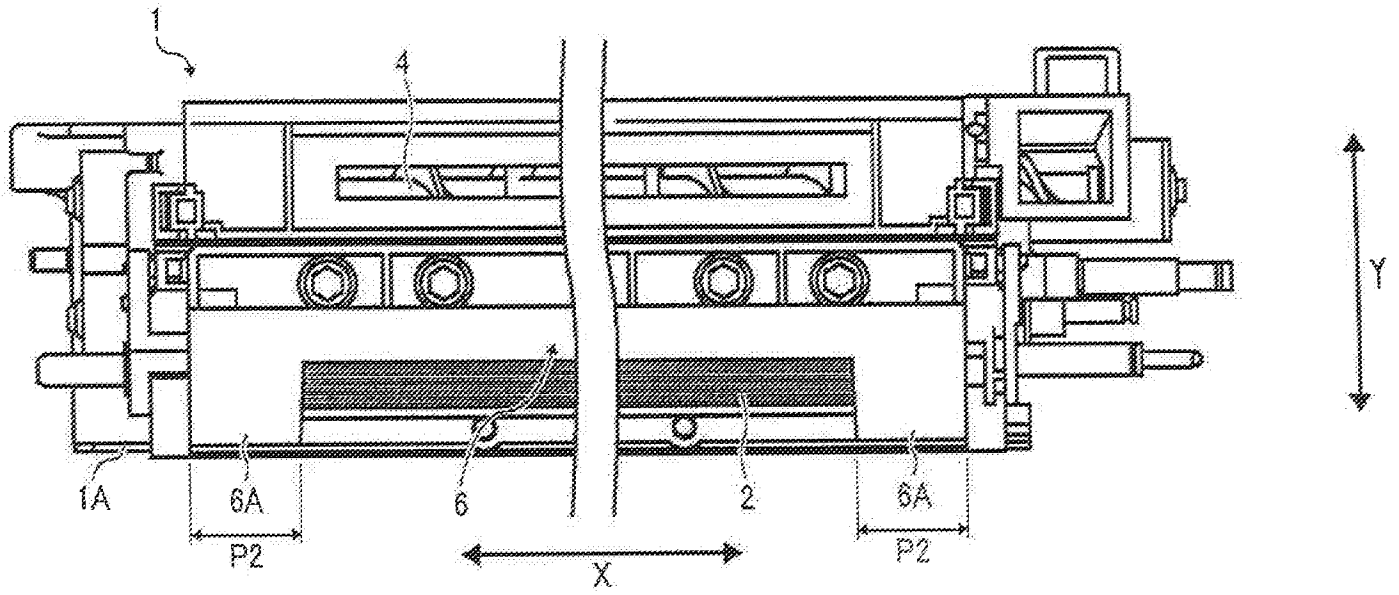
FIG. 8 is a view illustrating the gap adjusters and the seal in the developing device, as viewed from the side of a latent image bearer illustrated in FIG. 2.

In FIG. 5, a hatched portion (left side) of the seal 6 represents the long seal portion 6B, and the end seal portions 6A extend beyond the long seal portion 6B to the downstream side in the direction Y as illustrated in FIG. 8.

As illustrated in FIG. 8, the positions of the end seal portions 6A match the positions of the gap adjusters 5 disposed at both sides in the longitudinal direction X of the developer bearer 2. That is, the end seal portions 6A are disposed in the end ranges P2 in the longitudinal direction X and, as illustrated in FIG. 5, disposed to cover the outer side (the upper side in the present embodiment) of the developer bearer 2.

The end seal portions 6A are disposed not to hinder the sucked-in airflow Ab (see FIG. 7) in the end ranges P2. Specifically, an end 6A1 (adjacent to the gap adjuster 5) of each end seal portion 6A is above the gap adjuster 5 with a gap secured between the end 6A1 and the gap adjuster 5 (see FIGS. 5 and 7). The end seal portions 6A are disposed in the routes in which the air flows to blow out the developing device 1. Thus, the end seal portions 6A block the airflow.

As illustrated in FIG. 5, the long seal portion 6B shields a portion of the circumferential face of the developer bearer 2 from the photoconductor drum 10. Then, the long seal portion 6B blocks the flow of air from the developing device 1 to the photoconductor drum 10, thereby inhibiting the toner floating from the developing device 1 from adhering to the photoconductor drum 10.

Referring to FIG. 9, the image forming apparatus 100 includes, in an image forming section at almost a center of a housing 100A in the vertical direction, the process cartridge 20 illustrated in FIGS. 1 and 2, which includes the developing device 1 configured as described above. The image forming apparatus 100 illustrated in FIG. 9 includes a single process cartridge 20 to form monochrome images. The image forming apparatus 100 includes a sheet feeder 101 below the process cartridge 20 and a document scanner 102 above the process cartridge 20.

The sheet feeder 101 includes a sheet tray 101A to contain the sheets S, a pickup roller 101B, a feeding roller pair 101C, and a registration roller pair 101D disposed upstream from a transfer position (the transfer device 13) in a sheet feeding direction.

The document scanner 102 includes a movable mirror 102B to optically scan a document placed on a document table 102A, a condenser lens 102C, and a reading element 102D.

The toner image formed on the photoconductor drum 10 in the process cartridge 20 is transferred onto the sheet S fed from the sheet feeder 101. Then, a fixing device 103 fixes the toner image on the sheet S, after which the sheet S is ejected to an output tray 100A1 of the housing 100A.

Although the image forming apparatus 100 illustrated in FIG. 9 is configured to form monochrome images, image forming apparatuses according to the present disclosure can include multiple process cartridges, each of which includes the developing device 1 according to the above-described embodiment, depending on the number of image formation colors. In this case, the respective toner images formed in the process cartridges are sequentially transferred and superimposed one on another on an intermediate transfer member, and the superimposed images are transferred onto a recording medium at a time.

Although the embodiments of the present disclosure are described above, the present disclosure is not limited to the embodiments described above, but a variety of modifications can naturally be made within the scope of the present disclosure.

For example, the reduced-gap area can extend over, not limited to the areas outside the magnetized range P1, areas including ends of the magnetized range P1. In this configuration, the sucked-in airflow can be increased in strength in the area where the effect of the magnetic brush is unstable. Additionally, to increase the sucking-in airflow, on the premise that the reduced-gap area is set, suction air can be supplied to promote suction of the insufficiently charged toner into the developer container. Additionally, the gap adjusters according to the present disclosure are not necessarily made of an elastic material and, when an elastic material is used, not necessarily made of urethane foam. For example, the gap adjusters can be made of planar components capable of bending or deforming.

According to the above-described embodiment, the developing device 1 can inhibit leak of toner to the outside of the developing device 1, thereby inhibiting contamination with toner of the peripheral devices and the recording media.

Although preferable advantages are described above, advantages of the present disclosure are not limited to the advantages of the above-described embodiment.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a casing having an opening, the casing to contain developer; and a developer bearer including:

a magnetized range to cause developer to stand on end on a surface of the developer bearer; and an end range outside the magnetized range in a longitudinal direction of the developer bearer, the developer bearer disposed in the casing and partly exposed from the opening with a casing gap secured between the surface of the developer bearer and an inner face of the casing, the developer bearer to rotate to generate sucked-in airflow to collect a floating toner from the opening into the casing, the casing gap smaller in the end range than in the magnetized range.

2. The developing device according to claim 1, wherein the magnetized range is wider than a sheet feeding span in the longitudinal direction of the developer bearer.

3. The developing device according to claim 1, further comprising a gap adjuster disposed on the inner face of the casing, the gap adjuster disposed to face the end range of the developer bearer outside the magnetized range to reduce the casing gap in the end range.

4. The developing device according to claim 3, wherein the gap adjuster is made of an elastic material to deform elastically.

5. The developing device according to claim 3, wherein a face of the gap adjuster disposed facing the developer bearer has a surface roughness to attain a smoothness higher than a smoothness of the inner face of the casing.

6. The developing device according to claim 1, further comprising a seal attached to the casing to face the end range of the developer bearer.

7. The developing device according to claim 6, wherein the seal is disposed corresponding to the gap adjuster in the longitudinal direction of the developer bearer, and the seal covers an outer side of the developer bearer.

8. A process cartridge comprising:

a latent image bearer to bear a latent image; and the developing device according to claim 1 to develop the latent image on the latent image bearer.

9. An image forming apparatus comprising:

a plurality of process cartridges corresponding to a number of image formation colors, each of the plurality of process cartridges including:

a latent image bearer to bear a latent image; and the developing device according to claim 1 to develop the latent image on the latent image bearer.

10. A developing device comprising:

a casing having an opening, the casing to contain developer; and a developer bearer including:

a magnetized range to cause developer to stand on end on a surface of the developer bearer; and an end range outside the magnetized range in a longitudinal direction of the developer bearer;

the developer bearer disposed in the casing and partly exposed from the opening with a casing gap secured between the surface of the developer bearer and an inner face of the casing;

the developer bearer to rotate to generate sucked-in airflow to collect a floating toner from the opening into the casing;

the casing gap smaller in the end range than in the magnetized range;

wherein the magnetized range is wider than a sheet feeding span in the longitudinal direction of the developer bearer.

11. A developing device comprising:

a casing having an opening, the casing to contain developer; and a developer bearer including:

a magnetized range to cause developer to stand on end on a surface of the developer bearer; and an end range outside the magnetized range in a longitudinal direction of the developer bearer;

the developer bearer disposed in the casing and partly exposed from the opening with a casing gap secured between the surface of the developer bearer and an inner face of the casing;

the developer bearer to rotate to generate sucked-in airflow to collect a floating toner from the opening into the casing;

a gap adjuster disposed on the inner face of the casing, the gap adjuster disposed to face the end range of the developer bearer outside the magnetized range to reduce the casing gap in the end range to be smaller than in the magnetized range; and a face of the gap adjuster disposed facing the developer bearer has a surface roughness to attain a smoothness higher than a smoothness of the inner face of the casing.

* * * * *